United States Patent [19]

Luetzow

[11] Patent Number: 4,959,629

[45] Date of Patent: Sep. 25, 1990

[54] HIGH TORQUE ROTARY SOLENOID

[75] Inventor: Robert H. Luetzow, Huntington, Ind.

[73] Assignee: Kearney-National, Inc., White Plains, N.Y.

[21] Appl. No.: 356,119

[22] Filed: May 24, 1989

[51] Int. Cl.[5] ..... H01F 7/08

[52] U.S. Cl. ..... 335/228; 335/272

[58] Field of Search ..... 335/228, 229, 230, 272; 310/37

[56] References Cited

U.S. PATENT DOCUMENTS 3,320,445 5/1967 Bey ..... 310/37 X 3,690,191 9/1972 Ott ..... 310/37 X

*Primary Examiner*—George Harris

*Attorney, Agent, or Firm*—Woodard, Emhardt, Naughton Moriarty & McNett

[57] ABSTRACT

A high torque rotary solenoid is disclosed employing attracting and repelling forces of permanent magnets to induce rotary motion is disclosed. Four arrays of magnets are located on a stator and rotor and are arranged along the axis of rotation of a shaft. Two magnet arrays are located on the stator, and two magnet arrays are located on the rotor. Each of the magnet arrays on the stator is arranged to come in close proximity to one of the magnet arrays on the rotor when the rotary shaft is positioned to the clockwise or counterclockwise rotary motion limits. The rotary solenoid has two rotational positions, each position corresponding to the mechanical limits of rotational movement. A linear solenoid repositions the two permanent magnet arrays attached to the stator by moving the stator axially along the rotary shaft thereby reversing the existing polarity alignment of the arrays of magnets on the rotor versus the stator magnet arrays and creating rotational movement as a result of the attracting and repelling forces of the magnet arrays.

A power saving electrical control circuit is also disclosed, providing a high current initial activation signal thereby inducing the stator to move from a first to a second position. Once the stator magnetic cup has travelled to a mechanical movement limit, the control circuit reduces the activation current to a lower holding level to reduce power consumption and heat dissipation in the solenoid device.

7 Claims, 5 Drawing Sheets

HIGH TORQUE ROTARY SOLENOID

BACKGROUND OF THE INVENTION

This invention relates in general to rotary solenoids and more specifically to rotary solenoids utilizing permanent magnets for generating shaft torque and rotational movement.

Prior art rotary actuators of one type are exemplified by the patent to Leland et al., U.S. Pat. No. 3,264,530. Leland '530 discloses a rotary actuator adapted to convert an axial thrust to rotary movement. Magnetic forces developed axially are converted into rotary motion by inclined ball bearing races in the Leland device. A similar concept is employed in the rotary latching solenoid shown in Burton, U.S. Pat. No. 4,660,010. Axial forces imported to ball bearings in the Burton device facilitate rotary movement of the armature. Magnetic forces developed by way of current flowing through a coil latch the Burton device into the rotated position.

Still further examples of rotary solenoid devices are shown in U.S. Pat. No. 4,157,521 to Leland, and U.S. Pat. No. 3,278,875 to McDonough. The device disclosed in the '521 patent includes a multilobe armature attracted to magnetized pole pieces, thereby inducing rotary motion. The magnetic forces are created by current flowing through a coil. Ball bearing races limit the rotary travel of the '521 device. The novel concept in the '521 patent is a constant air gap wherein the shaft is not displaced axially during rotary movement of the actuator. McDonough discloses a similar rotary actuator concept wherein permeable metal is attracted to magnetized pole pieces thereby creating rotary motion.

A further example of coil induced magnetic fields causing or inducing rotary motion by way of magnetic forces is shown in Vogel, U.S. Pat. No. 4,275,371. Vogel discloses an armature shaft having magnets attached to the lateral surface of the shaft. Rotary motion is induced by way of magnetic forces created at three different points around the armature by electromagnets. A further example of a rotary solenoid using electromagnets and permanent magnets to induce rotary motion is the patent to McClintock, U.S. Pat. No. 4,135,138. McClintock discloses a device incorporating electromagnets to generate attracting and repelling forces for inducing rotary motion.

Further examples of solenoid actuators and/or linear actuators are shown in Ueno et al., U.S. Pat. No. 3,838,370, which discloses a linear actuating device. In addition, Belgian Pat. No. 648446 to Kommandit, and Russian Pat. No. SU 769-654 to Tyutkin disclose magnetically activated devices which produce axial or rotary motion.

A primary disadvantage of prior art devices which transform axial forces into rotary forces is that the force angles involved are so great and the force component so small that there is a great loss of force and torque in the transformation of the axial to the rotary motion. Further, devices such as that shown in McDonough, which attempt to overcome the shortcomings of the axial thrust devices include return springs which directly reduce the amount of torque developed by the magnetic circuitry components of the rotary actuator.

McClintock attempts to overcome the limitation imposed by the return spring forces as no return spring is included in the rotary solenoid device disclosed therein. Additionally, it should be noted that the space necessary to accommodate the requisite return spring in some of the prior art devices is eliminated by the McClintock design. The device disclosed in McClintock relies upon attractive forces developed between magnets mounted on a rotor and the surrounding housing to develop a magnetic force inducing rotary motion.

An electrical rotary actuator or solenoid which eliminates return springs, provides high torque response, and eliminates expensive bearing assemblies utilized in prior art devices to transform linear motion into rotary motion is disclosed herein.

SUMMARY OF THE INVENTION

A rotary solenoid device according to a typical embodiment of the present invention includes rotor means for producing rotary motion, the rotor means including a shaft and rotor magnetic means mounted at a radius on the shaft for producing directional magnetic flux substantially normal to the shaft at a radius from the shaft. The rotary solenoid further includes stator means in close proximity to the rotor means for inducing a rotary force to the rotor means. The stator means includes a stator magnetic means for producing north polarity magnetic flux substantially normal to the shaft at the radius above and incident upon said rotor magnetic means in a first position of the stator means, the stator magnetic means also producing a south polarity magnetic flux substantially normal to the shaft at said radius and incident upon the rotor magnetic means when the stator means is positioned in a second position. A solenoid actuator means is connected to the stator means for moving the stator means from a first to a second position along the axis of the shaft when the solenoid actuator means is activated. A spring return means is connected to the solenoid actuator means and is employed to move the actuator means from the second position to the first position when the solenoid actuator means is deactivated.

One object of this invention is to provide an improved rotary solenoid actuator.

Another object of the present invention is to provide a rotary actuator which produces higher torque with lower overall volume.

Another object of the present invention is to provide a rotary actuator wherein the current required to hold the actuator in the activated position is substantially less than prior art devices.

Related objects and advantages of the present invention will be apparent from the following description.

DESCRIPTION OF THE PREFERRED EMBODIMENT

Figure 1:
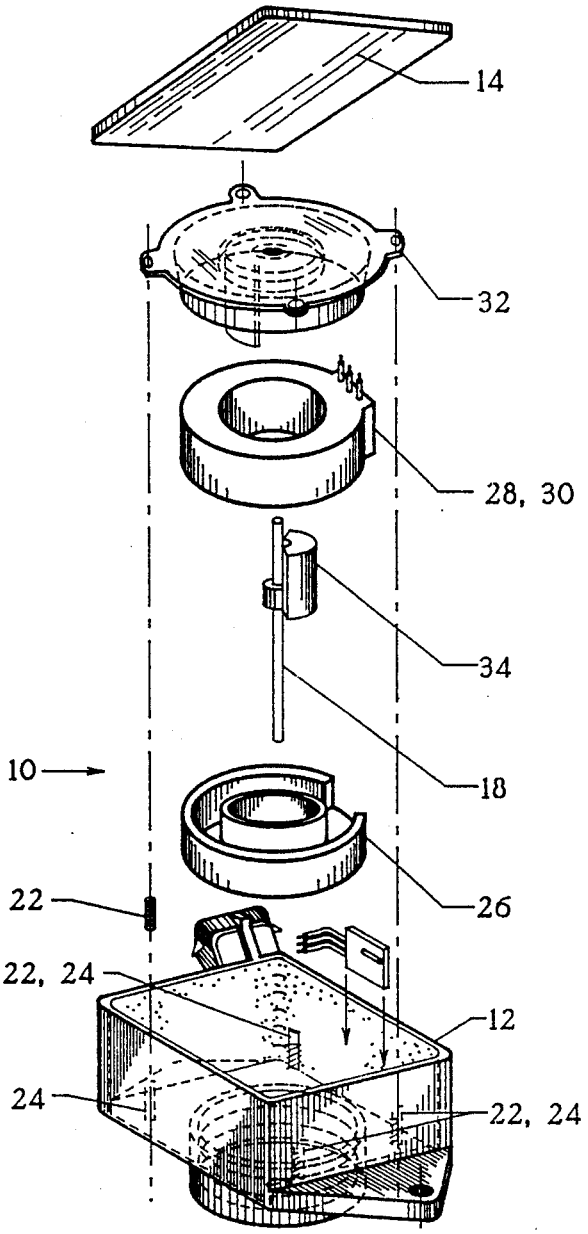
FIG. 1 is a vertically exploded view of one embodiment of the high torque rotary solenoid according to the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an exploded view of one embodiment of the high torque rotary solenoid 10 according to the invention is shown. Housing 12 has mounted therein at four locations guide pins 24 and springs 22 are placed upon guide pins 24. Bottom cup 26 rests in a recess of housing 12 at the bottom of housing 12. Shaft 18 and rotor 34 are fixedly connected. The shaft and rotor assembly 18 and 34 is inserted into a hole in the bottom of housing 12. Holding coil 28 and pick up coil 30 are wound about a form and then potted in epoxy to form the coil assembly 28, 30. The coil assembly rests in a groove of bottom cup 26. The magnetic actuator cup 32 includes a stator magnet stack therein. Actuator cup 32 is located on guide pins 24 when inserted into housing 12. Top cover 14 is mounted to the open top side of housing 12 after bottom cup 26, rotor assembly 18, 34, solenoid coils 28, 30 and magnetic actuator cup 32 are inserted within housing 12.

Figure 2:
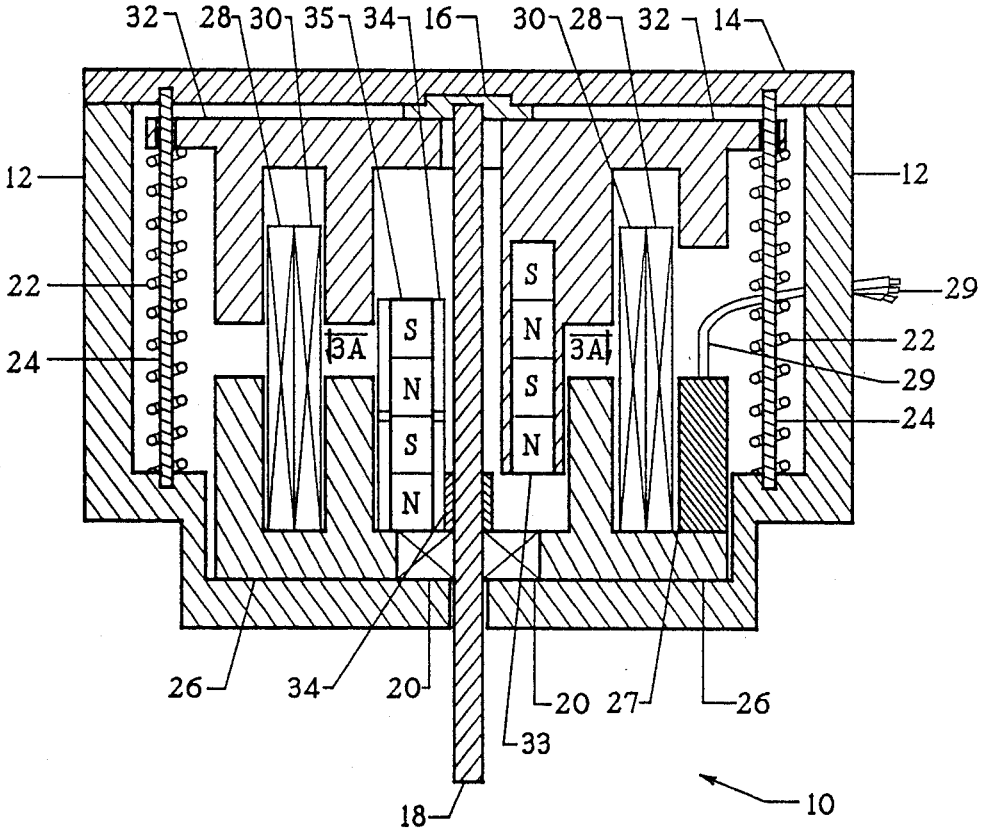
FIG. 2 is a vertical cross-section of the rotary solenoid shown in FIG. 1.

Referring now to FIG. 2, a vertical cross-section of the improved rotary actuator 10 according to the invention is shown. Housing 12 is shown having guide pins 24 mounted therein. Shaft 18 is positively located at the top by bearing 16 and at the bottom by bearing 20. Shaft 18 protrudes through the bottom of housing 12. Springs 22 provide the vertical force necessary to hold magnetic actuator cup 32 in the deactivated position as shown. Rotor 34 is shown having magnet stack 35 including four magnets positioned vertically adjacent each other with each adjacent magnet having opposite polarity. Magnet stack 35 is mounted to rotor 34. Magnetic actuator cup 32 includes the magnet stack 33 having four magnets vertically arranged with opposite adjacent polarity. Holding coil 28 and a pick-up coil 30 are integrally formed within an epoxy potting material, not shown. The electrical leads 29 connecting to coils 28 and 30 exit the coil assembly by way of locating tab 27. Electrical leads 29 are shown extending through housing 12 to the outside of the actuator housing 10. Control circuitry is connected to electrical leads 29 in order to provide current flow to coils 28 and 30. Bearing surface 16 is attached to top cover 14 and provides a locating position for shaft 18. Guide pins 24 are also located on their top side in top cover 14. Bottom magnetic cup 26 includes an area wherein coils 28 and 30 are fixedly attached. Magnetic actuator cup 32 and bottom cup 26 are preferably made of some magnetic material. Rotor 34 is made of a non-magnetic material, such as nylon, Teflon®, or plastic preferably brass. Pins 24 are made of metal. Housing 12 and top cover 14 are made of non-magnetic material. Shaft 18 is a stainless steel alloy or brass construction. Magnet stacks 35 and 33 include magnets made of rare earth materials, particularly samarium cobalt.

Operationally, in the deactivated position as is shown in FIG. 2, magnetic actuator cup 32 rests against bearing 16 on the upper side of cup 32. When current is supplied to coils 28 and 30, magnetic actuator cup 32 will move downward a fixed distance until the lower surface of cup 32 contacts the upper surface of cup 26. This distance is predetermined to coincide with the width of the individual magnets of the magnet stacks 35 and 33. By moving magnetic actuator cup 32 downwards the width of one of the magnet stack, that the polarities of the magnet stacks are rearranged so that what was attracting magnetic forces is now repelling forces with regard to the rotor position 34 and the magnetic actuator cup 32.

The embodiment shown in FIGS. 1 and 2 disclose a stator 32 movable axially with respect to the rotor 18, 34 (assembly), however, the rotary solenoid according to the invention is also contemplated as having a stator/magnet assembly axially fixed with respect to a rotor/shaft assembly wherein the rotor is axially movable on a grooved, spline, or slotted shaft in response to activation of a solenoid actuator.

Figure 3A:
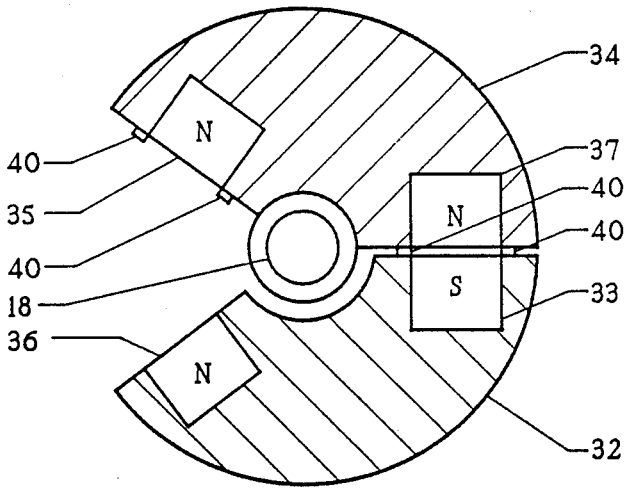
FIG. 3A-3A is a sectional view looking in the direction of the arrows 3A-3A of FIG. 2. depicting a sectional view of the stator and rotor of the rotary solenoid according to the invention.

Referring now to FIG. 3A—3A, a sectional view looking downward in the direction of the arrows 3A—3A provides a more detailed view of the relationship between the magnetic forces of the magnet stack 35 and 33 of FIG. 2. In addition, magnet stacks 36 and 37 are now visible. By arranging the magnet stacks to have alternating polarities and providing the ability to reposition the magnet stacks axially along the shaft, attracting or repelling forces can be simultaneously established between magnet stack 35 and 36, and magnet stack 37 and 33.

The magnetic actuator cup 32 of FIG. 2 moves downward as a result of the magnetic forces established by coils 28 and 30 between magnetic cups 32 and 26, the magnet stacks shown in FIG. 3A—3A will change position, and repelling forces are established between magnet stack 37 and 33, and attracting forces are established between magnet stack 35 and 36 thereby urging a counterclockwise rotary motion to shaft 18 of FIG. 3A—3A.

The embodiment shown includes four magnets in the stack of magnet stacks 35, 36, 33 and 37, however, as few as two magnets on the rotor and four magnets on the stator are required in order to render the invention functional. Additional magnets included in the embodiment shown provide more force to impart additional torque to shaft 18 upon the repositioning event of the magnetic actuator cup 32 with respect to the rotor 34. Further, as few as two magnets on the rotor (or stator) and one magnet on the stator (or rotor) can result in a functional rotary solenoid according to the invention. Tabs 40, shown in FIG. 3A—3A, serve to minimize frictional forces between rotor 34 and magnetic actuator cup 32 when the magnetic actuator cup 32 moves vertically to reposition the magnet stack in response to the activation or deactivation of current into coils 28 and 30 of FIG. 2.

Figure 4:
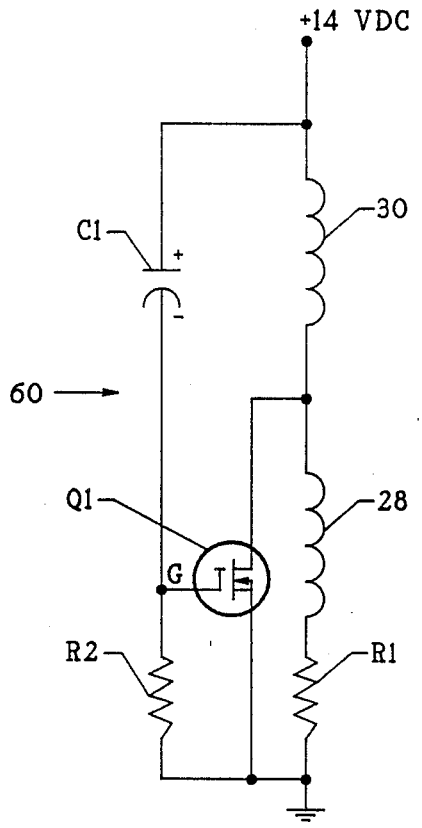
FIG. 4 is an electrical schematic of a control circuit employed to control the actuation of the high torque rotary solenoid according to the invention.

Referring now to FIG. 4, a control circuit 60 for the disclosed embodiment according to the invention is shown. To activate the magnetic actuator cup 32, 14 volts is applied to coil 30 and capacitor Cl. The voltage at the gate of Ql will instantly rise to 14 volts, thereby turning Ql on and allowing full current to flow from the plus 14 volt supply through coil 30 and down through device Ql to ground. In the on state Ql has an on resistance of less than 0.2 ohms, source to drain. A brief period of time later, the RC time constant established between capacitor Cl and resistor R2 will allow the voltage at the gate of Ql to rise thereby turning off the current flow through device Ql to ground from the connection between coils 30 and 28. After Ql is turned "off", current flow from the 14 volt supply will pass through coil 30, coil 28, and resistor Rl. This operational scheme provides an increased magnetic force between magnetic actuator cup 32 and bottom cup 26 of FIG. 1 in the initial time period following actuation of the rotary actuator. Once the coils have induced the magnetic actuator cup 32 to travel downward and contact the bottom cup 26 of FIG. 2, the MOSFET device, Ql, decreases the amount of current flow through the circuit by turning off, thereby conserving power, minimizing heat build-up, and providing only the minimal magnetic force necessary to hold magnetic cup 32 in abutment with magnetic cup 26. Typical values for the circuit shown in FIG. 4 are: Capacitor Cl—0.68 microfarads; resistor R2—27K ohms; resistor R1—20 ohms; and device Ql is preferably a logic level activated N-channel enhancement made silicon gate power field effect transistor manufactured by Motorola, Part No. MTP15N06L; a logic level activated MOSFET device capable of conducting 15 amps safely. The Motorola device can be obtained from Motorola Semiconductor Products, Inc., Box 20912, Phoenix, Ariz. 85036, a subsidiary of Motorola, Inc.

Typically, 30 milliseconds on-time for device Ql is sufficient to allow bottom magnetic cup 26 and magnetic actuator cup 32 to come together. Approximately 7 amps of current will flow initially through coil 30 and through device Ql to ground in the disclosed circuit. After 30 milliseconds, when the RC time constant between Cl and R2 allows the voltage at the gate of device Ql to rise above approximately 2 to 2 ½ volts, the logic level activation voltage of Ql, the current passing through coils 30 and 28 and through resistor Rl is diminished significantly, thereby conserving power and preventing heat build up.

Coil 30 is preferably a 240 turn coil of number 23-½ AWG wire. Coil 28 is preferably a 300 turn coil of number 32 AWG wire, but coil 28 can be eliminated if desired, in order to simplify manufacture. Additional current would be required without coil 28 in place, as it also provides a resistance to current flow in the circuit path from coil 30 to ground. Further, resistor Rl can be eliminated if the wire used to wind coil 28 has sufficient resistance to limit current flow from $+14V_{dc}$ to signal ground through coils 30 and 28.

Figure 5A:
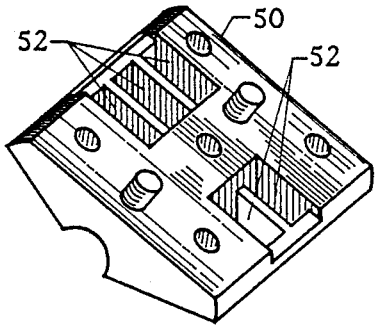
FIGS. 5A, and 5B are front and rear views respectively of another rotor embodiment according to the present invention.
Figure 5B:
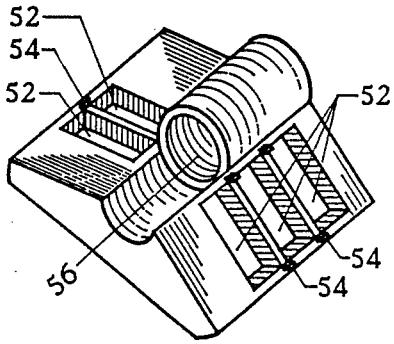

Referring now to FIGS. 5A and 5B, an alternate embodiment of the rotor 34 of FIG. 1 is shown. The rotor 50 of FIGS. 5A and 5B includes apertures 52 for mounting five magnets. Tabs 54 again are included in order to reduce frictional forces between the sliding surfaces of the magnetic actuating cup 32 and the rotor 50. Shaft receiving portion 56 provides a receptacle for fixedly receiving shaft 18. Again, the rotor 50 may be manufactured from any nonmetallic material such as nylon, plastic or Teflon ®.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A rotary solenoid comprising:

rotor means for producing rotary motion, said rotor means including a rotor member mounted on a shaft and rotor magnetic means mounted at a radius on said rotor member for producing directional magnetic flux substantially perpendicular to said shaft at a radius from said shaft;

stator means in close proximity to said rotor means for inducing a rotary force to said rotor means, said stator means including stator magnetic means for producing north polarity magnetic flux substantially perpendicular to said shaft at said radius and incident upon said rotor magnetic means in a first axial position of said stator means, said stator magnetic means also producing a south polarity magnetic flux substantially Perpendicular to said shaft at said radius and incident upon said rotor magnetic means when said stator means is axially positioned in a second position;

solenoid actuator means connected to said stator means for moving said stator means from said first to said second position when said solenoid actuator means is activated; and spring return means connected to said solenoid actuator means for moving said actuator means from said second to said first position when said solenoid actuator means is deactivated.

2. The rotary solenoid of claim 1 wherein said stator magnetic means includes a first rotor permanent magnet.

3. The rotary solenoid of claim 2 wherein said stator magnetic means includes a first and a second stator permanent magnet.

4. The rotary solenoid of claim 1 wherein said rotor means includes a first and a second rotor permanent magnet, said first rotor magnet mounted on said rotor member at said radius with the magnetic axis of said first rotor magnet positioned substantially perpendicular to said shaft, and said second rotor magnet mounted on said rotor member in the same axial plane as said first rotor magnet with the magnetic axis of said second rotor magnet substantially perpendicular to said shaft at said radius.

5. The rotary solenoid of claim 4 including a housing, said solenoid actuator means and said spring return means attached to a first inner surface of said housing, said stator means attached to a second inner surface of said housing, and said rotor means rotatably mounted within said housing with said shaft extending through said housing.

6. A rotary solenoid comprising:

a stator and a rotor axially and rotatably movable relative to each other;

a shaft rotatably connected to said rotor;

a first and a second stator magnet both rigidly mounted to said stator with the magnetic polar axis of said stator magnets positioned substantially perpendicular to said shaft, parallel with each other in opposing polarity, and at a radius from said shaft;

a first rotor magnet fixedly mounted to said rotor at said radius and positioned substantially perpendicular to the axis of rotation of said shaft and with the polar axis of said first rotor magnet positioned in the same plane as the polar axis of said first stator magnet;

actuator means connected to said rotor and stator for relatively positioning said stator and rotor so that said first rotor magnet is placed in the same plane as the plane in which the polar axis of said second stator magnet is positioned when said actuator means is activated.

7. The rotary solenoid of claim 6 including spring return means for mechanically biasing rotor and stator into a position wherein the polar axis of said first stator magnet is in the same plane as the polar axis of said first rotor magnet.

* * * * *

UNITED STATES PATENT AND TRADEMARK OFFICE

CERTIFICATE OF CORRECTION

PATENT NO. : 4,959,629

DATED : September 25, 1990

INVENTOR(S) : Robert H. Luetzow

It is certified that error appears in the above-identified patent and that said Letters Patent is hereby corrected as shown below:

In column 6, line 16, please replace the word "Perpendicular" with the word --perpendicular--.

Signed and Sealed this

Twenty-fourth Day of December, 1991

*Attest:*

HARRY F. MANBECK, JR.

*Attesting Officer*

*Commissioner of Patents and Trademarks*